US008746324B2

(12) United States Patent
Chen et al.

(10) Patent No.: US 8,746,324 B2
(45) Date of Patent: Jun. 10, 2014

(54) USE OF ALUMINUM-ZIRCONIUM-CARBON INTERMEDIATE ALLOY IN WROUGHT PROCESSING OF MAGNESIUM AND MAGNESIUM ALLOYS

(75) Inventors: Xuemin Chen, Guangdong (CN); Qingdong Ye, Guangdong (CN); Yueming Yu, Guangdong (CN); Jianguo Li, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 313 days.

(21) Appl. No.: 13/141,467

(22) PCT Filed: Apr. 22, 2011

(86) PCT No.: PCT/CN2011/073181

§ 371 (c)(1),
(2), (4) Date: Jun. 22, 2011

(87) PCT Pub. No.: WO2012/027989

PCT Pub. Date: Mar. 8, 2012

(65) Prior Publication Data

US 2012/0043050 A1 Feb. 23, 2012

(30) Foreign Application Priority Data

Mar. 15, 2011 (CN) ..... 2011 1 0060746

(51) Int. Cl.
*B22D 11/00* (2006.01)
*B22D 11/10* (2006.01)
*B22D 27/02* (2006.01)

(52) U.S. Cl.
USPC ..... 164/462; 164/473; 164/492; 164/480

(58) Field of Classification Search
USPC ..... 164/47, 462, 473, 466–468, 492, 498, 164/499, 423, 55.1, 57.1, 480
See application file for complete search history.

(56) References Cited

U.S. PATENT DOCUMENTS

| | | | | |
|---|---|---|---|---|
| 4,612,073 | A * | 9/1986 | Guzowski et al. | 148/415 |
| 7,814,961 | B2 * | 10/2010 | Numano et al. | 164/480 |
| 2008/0216924 | A1 * | 9/2008 | Schumacher et al. | 148/538 |

* cited by examiner

*Primary Examiner* — Kevin P Kerns
*Assistant Examiner* — Steven Ha
(74) *Attorney, Agent, or Firm* — Jackson IPG PLLC

(57) ABSTRACT

The present invention relates to the field of magnesium and magnesium alloy processing, and discloses a use of aluminum-zirconium-carbon (Al—Zr—C) intermediate alloy in wrought processing of magnesium and magnesium alloys, wherein the aluminum-zirconium-carbon intermediate alloy has a chemical composition of: 0.01% to 10% Zr, 0.01% to 0.3% C, and Al in balance, based on weight percentage; the wrought processing is plastic molding; and the use is to refine the grains of magnesium or magnesium alloys. The present invention further discloses the method for using the aluminum-zirconium-carbon (Al—Zr—C) intermediate alloy in casting and rolling magnesium and magnesium alloys. The present invention provides an aluminum-zirconium-carbon (Al—Zr—C) intermediate alloy and the use thereof in the plastic wrought processing of magnesium or magnesium alloys as a grain refiner. The aluminum-zirconium-carbon intermediate alloy has the advantages of great ability in nucleation and good grain refining effect, and achieves the continuous and large-scale production of wrought magnesium and magnesium alloy materials.

10 Claims, 1 Drawing Sheet

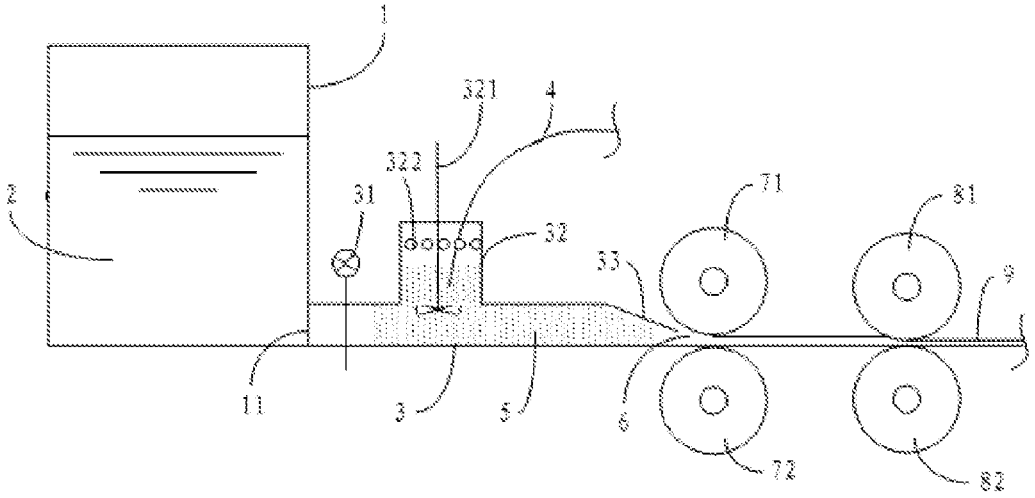
1
321
4
322
2
31
71
81
32
33
9
11
3
5
6
72
82

USE OF ALUMINUM-ZIRCONIUM-CARBON INTERMEDIATE ALLOY IN WROUGHT PROCESSING OF MAGNESIUM AND MAGNESIUM ALLOYS

FIELD OF THE INVENTION

The present invention relates to a use of Al-based intermediate alloy in processing, especially a use of aluminum-zirconium-carbon intermediate alloy in wrought processing magnesium and magnesium alloy.

BACKGROUND OF THE INVENTION

The use of magnesium and magnesium alloy in industries started in 1930s. Since magnesium and magnesium alloys are the lightest structural metallic materials at present, and have the advantages of low density, high specific strength and stiffness, good damping shock absorption, heat conductivity, and electromagnetic shielding performance, excellent machinability, stable part size, easy recovery, and the like, magnesium and magnesium alloys, especially wrought magnesium alloys, possess extremely enormous utilization potential in the filed of transportation, engineering structural materials, and electronics. Wrought magnesium alloy refers to the magnesium alloy formed by plastic molding methods such as extruding, rolling, forging, and the like. However, due to the constraints in, for example, material preparation, processing techniques, anti-corrosion performance and cost, the use of magnesium alloy, especially wrought magnesium alloy, is far behind steel and aluminum alloys in terms of utilization amount, resulting in a tremendous difference between the developing potential and practical application thereof, which never occurs in any other metal materials.

The difference of magnesium from other commonly used metals such as iron, copper, and aluminum lies in that, its alloy exhibits closed-packed hexagonal crystal structure, has only 3 independent slip systems at room temperature, is poor in plastic wrought, and is significantly affected by grain sizes in terms of mechanical property. Magnesium alloy has relatively wide range of crystallization temperature, relatively low heat conductivity, relatively large volume contraction, serious tendency to grain growth coarsening, and defects of generating shrinkage porosity, heat cracking, and the like during setting. Since finer grain size facilitates reducing shrinkage porosity, decreasing the size of the second phase, and reducing defects in forging, the refining of magnesium alloy grains can shorten the diffusion distance required by the solid solution of short grain boundary phases, and in turn improves the efficiency of heat treatment. Additionally, finer grain size contributes to improving the anti-corrosion performance and machinability of the magnesium alloys. The application of grain refiner in refining magnesium alloy melts is an important means for improving the comprehensive performances and forming properties of magnesium alloys. The refining of grain size can not only improve the strength of magnesium alloys, but also the plasticity and toughness thereof, thereby enabling large-scale plastic processing and low-cost industrialization of magnesium alloy materials.

It was found in 1937 that the element that has significantly refining effect for pure magnesium grain size is Zr. Studies have shown that Zr can effectively inhibits the growth of magnesium alloy grains, so as to refine the grain size. Zr can be used in pure Mg, Mg—Zn-based alloys, and Mg-RE-based alloys, but can not be used in Mg—Al-based alloys and Mg—Mn-based alloys, since it has a very small solubility in liquid magnesium, that is, only 0.6 wt % Zr dissolved in liquid magnesium during peritectic reaction, and will be precipitated by forming stable compounds with Al and Mn. Mg—Al-based alloys are the most popular, commercially available magnesium alloys, but have the disadvantages of relatively coarse cast grains, and even coarse columnar crystals and fan-shaped crystals, resulting in difficulties in wrought processing of ingots, tendency to cracking, low finished product rate, poor mechanical property, and very low plastic wrought rate, which adversely affects the industrial production thereof. Therefore, the problem existed in refining magnesium alloy cast grains should be firstly addressed in order to achieve large-scale production. The methods for refining the grains of Mg—Al-based alloys mainly comprise overheating method, rare earth element addition method, and carbon inoculation method. The overheating method is effective to some extent; however, the melt is seriously oxidized. The rare earth element addition method has neither stable nor ideal effect. The carbon inoculation method has the advantages of broad source of raw materials and low operating temperature, and has become the main grain refining method for Mg—Al-based alloys. Conventional carbon inoculation methods add $MgCO_3$, $C_2Cl_6$, or the like to a melt to form large amount of disperse $Al_4C_3$ mass points therein, which are good heterogeneous crystal nucleus for refining the grain size of magnesium alloys. However, such refiners are seldom adopted because their addition often causes the melt to be boiled. In summary, a general-purpose grain intermediate alloy has not been found in the industry of magnesium alloy, and the applicable range of various grain refining methods depends on the alloys or the components thereof. Therefore, a key to achieve the industrialization of magnesium alloys is to find a general-purpose grain refiner capable of effectively refining cast grains when solidifying magnesium and magnesium alloys and a method using the same in continuous production.

SUMMARY OF THE INVENTION

The use of aluminum-zirconium-carbon (Al—Zr—C) intermediate alloy in the wrought processing of magnesium and magnesium alloys is provided in order to address the above-mentioned problems existed at present.

The present invention adopts the following technical solution: the use of aluminum-zirconium-carbon intermediate alloy in wrought processing of magnesium and magnesium alloys, wherein the aluminum-zirconium-carbon (Al—Zr—C) intermediate alloy has a chemical composition of: 0.01% to 10% Zr, 0.01% to 0.3% C, and Al in balance, based on weight percentage; the wrought processing is plastic molding; and the use is to refine the grains of magnesium or magnesium alloys.

Preferably, the aluminum-zirconium-carbon (Al—Zr—C) intermediate alloy has a chemical composition of: 0.1% to 10% Zr, 0.01% to 0.3% C, and Al in balance, based on weight percentage. More preferably, the chemical composition is: 1% to 5% Zr, 0.1% to 0.3% C, and Al in balance.

Preferably, the content of impurities present in the aluminum-zirconium-carbon (Al—Zr—C) intermediate alloy are: Fe of no more than 0.5%, Si of no more than 0.3%, Cu of no more than 0.2%, Cr of no more than 0.2%, and other single impurity element of no more than 0.2%, based on weight percentage.

Preferably, the plastic molding is performed by extruding, rolling, forging or the combination thereof. When the plastic molding is performed by rolling, casting and rolling is preferably adopted to form plate or wire materials. The casting and rolling process comprises sequentially and continuously performing the steps of melting, temperature-adjusting, and casting and rolling magnesium or magnesium alloys. More preferably, the aluminum-zirconium-carbon (Al—Zr—C) intermediate alloy is added to the melt of magnesium or magnesium alloys after the temperature adjusting step and before the casting and rolling step. Still more preferably, the temperature adjusting step adopts a resistance furnace, the casting and rolling step adopts casting roller, the resistance furnace is provided with a liquid outlet at the lower end of the side wall, the casting rollers are provided with an engaging zone, a melt delivery pipe is connected between the liquid outlet and the engaging zone, and the aluminum-zirconium-carbon intermediate alloy is added to the melt of magnesium or magnesium alloy via the grain refiner inlet. Most preferably, the grain refiner inlet is provided with an agitator which uniformly disperses the aluminum-zirconium-carbon intermediate alloy in the melt of magnesium or magnesium alloy by agitating. Further preferably, the space over the melt of magnesium or magnesium alloy in the grain refiner inlet is filled with protective gas, which is a mixture gas of $SF_6$ and $CO_2$.

More preferably, the aluminum-zirconium-carbon intermediate alloy is a wire having a diameter of 9 to 10 mm.

The present invention has the following technical effects: providing an aluminum-zirconium-carbon (Al—Zr—C) intermediate alloy and the use thereof in the plastic wrought processing of magnesium or magnesium alloys as a grain refiner, which has the advantages of great ability in nucleation and good grain refining effect; and further proving a method for using the aluminum-zirconium-carbon intermediate alloy in casting and rolling magnesium and magnesium alloys, which can achieve continuous and large-scale production of wrought magnesium and magnesium alloy materials.

BRIEF DESCRIPTION OF DRAWINGS

FIG. 1 is a schematic diagram showing the use of Al—Zr—C intermediate alloy in the continuous casting and rolling production of magnesium and magnesium alloys according to one embodiment of the present invention.

DETAILED DESCRIPTION OF THE PREFERRED EMBODIMENT

The present invention can be further expressly explained by specific examples of the invention given below which, however, are not intended to limit the scope of the present invention.

EXAMPLE 1

Commercially pure aluminum, zirconium scarp and graphite powder were weighed in a weight ratio of 96.85% Al, 3% Zr, and 0.15% C. The graphite powder had an average particle size of 0.27 mm to 0.83 mm The graphite powder was soaked in 2 g/L KF aqueous solution at 65±3° C. for 24 hours, filtrated to remove the solution, dried at 120±5° C. for 20 hours, and then cooled to room temperature for use. Aluminum was added to an induction furnace, melt, and heated to a temperature of 770±10° C., in which the zirconium scarp and the soaked graphite powder were sequentially added and completely dissolved under agitation. The resultant mixture was kept at the temperature, continuously and mechanically agitated to be homogenized, and then processed by casting and rolling into coiled wires having a diameter of 9.5 mm.

EXAMPLE 2

Commercially pure aluminum, zirconium scarp and graphite powder were weighed in a weight ratio of 90.0% Al, 9.7% Zr, and 0.3% C. The graphite powder had an average particle size of 0.27 mm to 0.55 mm The graphite powder was soaked in 2 g/L $K_2TiF_6$ aqueous solution at 95±3° C. for 36 hours, filtrated to remove the solution, dried at 110±5° C. for 24 hours, and then cooled to room temperature for use. Aluminum was added to an induction furnace, melt, and heated to a temperature of 870±10° C., in which the zirconium scarp and the soaked graphite powder were sequentially added and completely dissolved under agitation. The resultant mixture was kept at the temperature, continuously and electromagnetically agitated to be homogenized, and then processed by casting and rolling into coiled wires having a diameter of 9.5 mm.

EXAMPLE 3

Commercially pure aluminum, zirconium scarp and graphite powder were weighed in a weight ratio of 99.87% Al, 0.1% Zr, and 0.03% C. The graphite powder had an average particle size of 0.1 mm to 0.25 mm The graphite powder was soaked in 0.3 g/L $K_2TiF_6$ aqueous solution at 70±3° C. for 48 hours, filtrated to remove the solution, dried at 170±5° C. for 12 hours, and then cooled to room temperature for use. Aluminum was added to an induction furnace, melt, and heated to a temperature of 760±10° C., in which the soaked graphite powder and the zirconium scarp were sequentially added and completely dissolved under agitation. The resultant mixture was kept at the temperature, continuously and mechanically agitated to be homogenized, and then processed by casting and rolling into coiled wires having a diameter of 9.5 mm.

EXAMPLE 4

Mg-5% Al alloy was melt in an induction furnace under the protection of a mixture gas of $SF_6$ and $CO_2$, heated to a temperature of 740° C., refined by adding 1% Al—Zr—C intermediate alloy prepared according to example 1, kept at the constant temperature under agitation for 30 minutes, and directly cast to ingots.

The Mg-5% Al alloy before and after refining were analyzed and compared under scanning electron microscope. Measurements were made by using cut-off point method under GB/T 6394-2002 to provide an average alloy grain diameter of 150 μm for the unrefined alloy, and an average alloy grain diameter of 50 μm for the refined alloy cast, both under the same conditions. The test results show that the Al—Zr—C intermediate alloys according to the present invention have very good effect in refining the grains of magnesium alloys.

EXAMPLE 5

Reference is made to FIG. 1, which shows the use of aluminum-zirconium-carbon (Al—Zr—C) intermediate alloy as grain refiner in processing magnesium or magnesium alloy plates. The temperature of melt magnesium liquid or magnesium alloy liquid is adjusted in a resistance furnace 1, so that the temperature of the liquids is uniform and reaches the value required for casting and rolling. In the resistance furnace 1, multiple stages, for example 3 stages, of temperature adjustment can be arranged, with individual stages being separated by iron plates from each other, and the liquids overflowing over the iron plates to a lower stage. A liquid outlet 11 is arranged at the lower end of one side wall of the resistance furnace 1, and connected with a melt delivery pipe 3, which has a valve 31 near the liquid outlet 11. A grain refiner input 32 is arranged in the middle upper wall of the melt delivery pipe 3, and is provided with an agitator 321 therein. The front end of the melt delivery pipe is an applanate, contracted port 33, which extents into the engaging zone 6 of casting rollers 71 and 72. A pair of casting rollers 81 and 82 or multiple pairs of casting rollers, if necessary, can be arranged following the casting rollers 71 and 72. The temperature of the magnesium or magnesium alloy liquid 2 being subjected to temperature adjustment is controlled at 700±10° C. As the casting and rolling start, the valve 31 is opened, the magnesium or magnesium alloy liquid 2 flows into the melt delivery pipe 3 and further enters the grain refiner inlet 32 under the pressure of the melt. The Al—Zr—C intermediate alloy wire 4 prepared according to any of the above examples is uncoiled and inserted into the melt entering the grain refiner inlet 32 as the grain refiner, and continuously and uniformly dissolved in the magnesium or magnesium alloy melt to from large amount of disperse ZrC and $Al_4C_3$ mass points acting as crystal nucleus. The mixture is agitated by the agitator 321 to provide a casting liquid 5 having crystal nucleus uniformly dispersed therein. The manner by which the grain refiner is added in the casting and rolling processing of magnesium or magnesium alloys greatly avoids the decrease in nucleation ability caused by the precipitation and decrement of crystal nucleus when adding Al—Zr—C grain refiner at temperature adjusting step or previous melting step, thereby substantially improve the grain refining performance of the Al—Zr—C intermediate alloy. Since magnesium liquid is extremely tended to be burn when meeting oxygen, an 8-15 cm-thick mixture gas of $SF_6$ and $CO_2$ is filled into the space over the melt in the grain refiner inlet 32 as protective gas 322. The protective gas 322 can be introduced from fine and dense holes arranged on the lower end of the side wall of the pipe coil positioned over the melt in the grain refiner inlet 32. The cast liquid 5 enters the engaging zone 6 of the casting rollers 71 and 72 via contracted port 33 to be cast and rolled. The temperature of the cast liquid 5 is controlled at 690±10° C., and the temperature of the casting roller 71 and 72 is controlled between 250 and 350° C., with an axial temperature difference of no more than 10° C. The cast liquid 5 is cast and rolled into blank plates of magnesium or magnesium alloys, in which the grains are refined during casting and rolling to enhance the comprehensive properties of magnesium alloy and improve the molding performance and machinability thereof. The blank plates are subjected to sequential one or more pair of casting rollers to provide magnesium or magnesium alloy plates 9 having desired size, in which the grains of magnesium or magnesium alloys are further refined.

What is claimed is:

1. A magnesium alloy production process, comprising melting magnesium or a first magnesium alloy and separately adding a Al—Zr—C intermediate alloy having a chemical composition of: 0.01% to 10% Zr, 0.01% to 0.3% C, and Al in balance, based on weight percentage; and plastic molding a resulting magnesium alloy so as to obtain at least one of resulting magnesium alloy wire and plate materials having refined grains.

2. The magnesium alloy production process according to claim 1, wherein the contents of impurities present in the Al—Zr—C intermediate alloy are: Fe of no more than 0.5%, Si of no more than 0.3%, Cu of no more than 0.2%, Cr of no more than 0.2%, and any other single impurity element of no more than 0.2%, based on weight percentage.

3. The magnesium alloy production process according to claim 1, wherein the plastic molding is performed by extruding, rolling, forging or the combination thereof.

4. The magnesium alloy production process according to claim 3, wherein the plastic molding is performed by rolling which comprises casting and rolling to form the plate or wire materials.

5. The magnesium alloy production process according to claim 4, wherein the casting and rolling process comprises sequentially and continuously performing the steps of melting, temperature-adjusting, and casting and rolling magnesium or first magnesium alloys.

6. The magnesium alloy production process according to claim 1, wherein the Al—Zr—C intermediate alloy is separately added to the melt of the magnesium or first magnesium alloy after a temperature adjusting step and before a casting and rolling step.

7. The magnesium alloy production process according to claim 6, wherein the temperature adjusting step adopts a resistance furnace, the casting and rolling step adopts casting rollers, the resistance furnace is provided with a liquid outlet at a lower end of a side wall, the casting rollers are provided with an engaging zone, a melt delivery pipe is connected between the liquid outlet and the engaging zone, and the Al—Zr—C intermediate alloy is added to the melt of magnesium or first magnesium alloy via a grain refiner inlet.

8. The magnesium alloy production process according to claim 7, wherein the grain refiner inlet is provided with an agitator which uniformly disperses the Al—Zr—C intermediate alloy in the melt of magnesium or first magnesium alloy by agitating.

9. The magnesium alloy production process according to claim 7, wherein the Al—Zr—C intermediate alloy is a wire having a diameter of 9 to 10 mm.

10. The magnesium alloy production process according to claim 7, wherein a space over the melt of magnesium or first magnesium alloy in the grain refiner inlet is filled with protective gas, which is a mixture gas of $SF_6$ and $CO_2$.

* * * * *